United States Patent [19]

Greive

[11] 4,068,458

[45] Jan. 17, 1978

[54] BALLOON SUPPRESSOR FOR LIGHT AND HEAVY YARNS

[75] Inventor: Aloys Greive, Munster, Germany

[73] Assignee: Hamel GmbH Zwirnmaschinen, Munster, Germany

[21] Appl. No.: 724,461

[22] Filed: Sept. 17, 1976

[30] Foreign Application Priority Data

Sept. 17, 1975 Germany ..... 2541493

[51] Int. Cl.[2] ..... D01H 1/10; D01H 1/42

[52] U.S. Cl. ..... 57/108; 57/58.83

[58] Field of Search ..... 57/58.83, 108

[56] References Cited

U.S. PATENT DOCUMENTS

| | | | |
|---|---|---|---|
| 3,299,624 | 1/1967 | Nimtz | 57/108 |
| 3,327,465 | 6/1967 | Nimtz | 57/108 |
| 3,380,240 | 4/1968 | Franzen | 57/58.83 |
| 3,410,074 | 11/1968 | Nimtz et al. | 57/108 |
| 3,430,431 | 3/1969 | Nimtz et al. | 57/108 |
| 3,648,449 | 3/1972 | Greive | 57/108 X |

*Primary Examiner*—Richard C. Queisser
*Assistant Examiner*—Charles Gorenstein
*Attorney, Agent, or Firm*—Karl F. Ross

[57] ABSTRACT

A twisting apparatus for light and heavy yarns has a conventional twister wherein the yarn packages are supported rotatably on a rotating flyer but is inhibited from rotation by magnets on the yarn-package holder and upright walls surrounding the yarn-package holder. The flyer is rotated at high speed so as to form a yarn balloon around the yarn-package. The walls surrounding the yarn-package holder form a square at their tops and a circle at their bottoms. When heavy-gauge yarns are being twisted an insert in the form of a cylindrical sleeve is fitted within the device to limit the balloon size. An elastomeric ring surrounding the lower portion of the outside of this sleeve is snugly engageable with the frustoconical lower surface of the interior of the surrounding walls so as to hold the sleeve centered in the apparatus.

11 Claims, 3 Drawing Figures

BALLOON SUPPRESSOR FOR LIGHT AND HEAVY YARNS

CROSS-REFERENCE TO RELATED APPLICATIONS

This application is related to commonly assigned copending patent applications Ser. No. 724,462 and Ser. No. 724,460, both filed 17 Sept. 1976.

FIELD OF THE INVENTION

The present invention relates to a twisting apparatus. More particularly this invention concerns a twisting apparatus wherein the rotating mechanism is encapsulated or closed in.

BACKGROUND OF THE INVENTION

A twisting apparatus comprises a yarn-package holder which is rotatably supported on a rotatable flyer. The flyer itself is supported on a spindle having a whorl so that it can be rotated at high speed. The yarn-package holder is, however, held nonrotatably, often by magnets arranged in the yarn holder and in the wall of the surrounding structure. One or more yarns are pulled off one or more packages on the yarn holder upwardly and then passed downwardly through the spindle of the device. The yarn is then passed radially outwardly through the rotating flyer and is pulled upwardly to a takeup device including an eye located above the arrangement generally on the rotation axis for the flyer. Thus, the thread as it is pulled up around the yarn package forms a so-called balloon, as it moves with such high speed that it appears to be a solid object (see German Auslegeschrift DT-AS 1924508 which corresponds to U.S. Pat. No. 3,648,449.

Since the yarn packages are standing still and the flyer is rotating the yarn or yarns pulled off the packages on the holder are twisted together so as to form a strong thread.

As long as relatively light yarns are used the above-described balloon stands free of the inner walls of the structure surrounding the yarn-package holder, or at most only touches these walls. When, however, relatively heavy yarn is being twisted the centrifugal force tends to pull it more strongly toward the wall so that the balloon, if the yarn is twisted at too high a speed, rubs on the wall of the structure surrounding the yarn holder. Such rubbing is very disadvantageous in that it can cause premature wear and breakage of the yarn as it is being spun. Thus it is normal practice in such devices to drive the flyer much more slowly when it is used to twist heavy yarns than when it is used to twist lighter yarns. This lower speed reduces the centrifugal force effective on the yarn but also considerably reduces down production speed.

OBJECTS OF THE INVENTION

It is therefore an object of the present invention to provide an improved twisting apparatus.

Yet another object is to provide such an apparatus which can twist both light and heavy yarns at high speed.

SUMMARY OF THE INVENTION

These objects are attained according to the present invention in an improvement that is used in a twisting apparatus where the yarn-package is supported on a rotatably supported holder in a laterally closed but upwardly open space defined between a plurality of upright walls defining at least adjacent their bases a circle, and wherein coacting magnets on the holder and at least one of the walls at the base thereof prevent rotation of the holder. The improvement comprises a balloon-limiting sleeve of generally cylindrical shape receivable between the holder and the wall and means for releasably securing this sleeve in the base on the walls for easy removal from this base.

According to further features of this invention these walls define at their tops a square and at their bottoms a circle, uniformly transactioning between the two so that the square top blends into the round base. The apparatus according to this invention also further comprises a flyer under and rotatably supporting the holder for rotation about an upright axis. The sleeve is centered on this axis and secured on the walls.

In accordance with further features of this invention the means for securing the sleeve is the formation on the sleeve that is snugly engageable with the wall at the base thereof. This formation engages the walls generally at the magnets and is formed by a circumferential external ring of elastic material secured to the sleeve. The walls are tapered downwardly so as to have a generally frustoconical shape near their bases, and the formation on the sleeve is the outer surface and is complementarily frustoconical.

In accordance with yet another feature of this invention the sleeve is of nonmagnetic material and the magnets may be polarized either in a direction parallel to the rotation axis of the flyer or radially thereof.

Thus with the system according to the present invention it is possible simply to put the insert into the wall surrounding the yarn-holder when a heavy yarn is to be twisted so as to limit the overall diameter of the balloon that will be formed by the yarn. This makes it possible to spin even relatively heavy yarns at high speed so that no decrease in production is entailed when larger yarns are being treated. Furthermore such use of a balloon-limiting sleeve insert almost completely eliminates the possibility of breakage of relatively heavy yarns when they are being twisted.

According to further features of this invention the sleeve is cylindrical and formed of sheet aluminum. The ring seated thereon is a rectangular section and made of an elastomer, such as rubber or a suitable synthetic resin.

According to yet another feature of this invention means is provided for spraying a fabric-finishing chemical lubricant such as wax, size, or drooping into the balloon-limiting sleeve in order to facilitate sliding of the yarn on its interior and further prevent breaking of this yarn.

BRIEF DESCRIPTION OF THE DRAWING

The above and other objects, features, and advantages of the invention will become more readily apparent from the following description, reference being made to the accompanying drawing in which.

SPECIFIC DESCRIPTION

Figure 1:
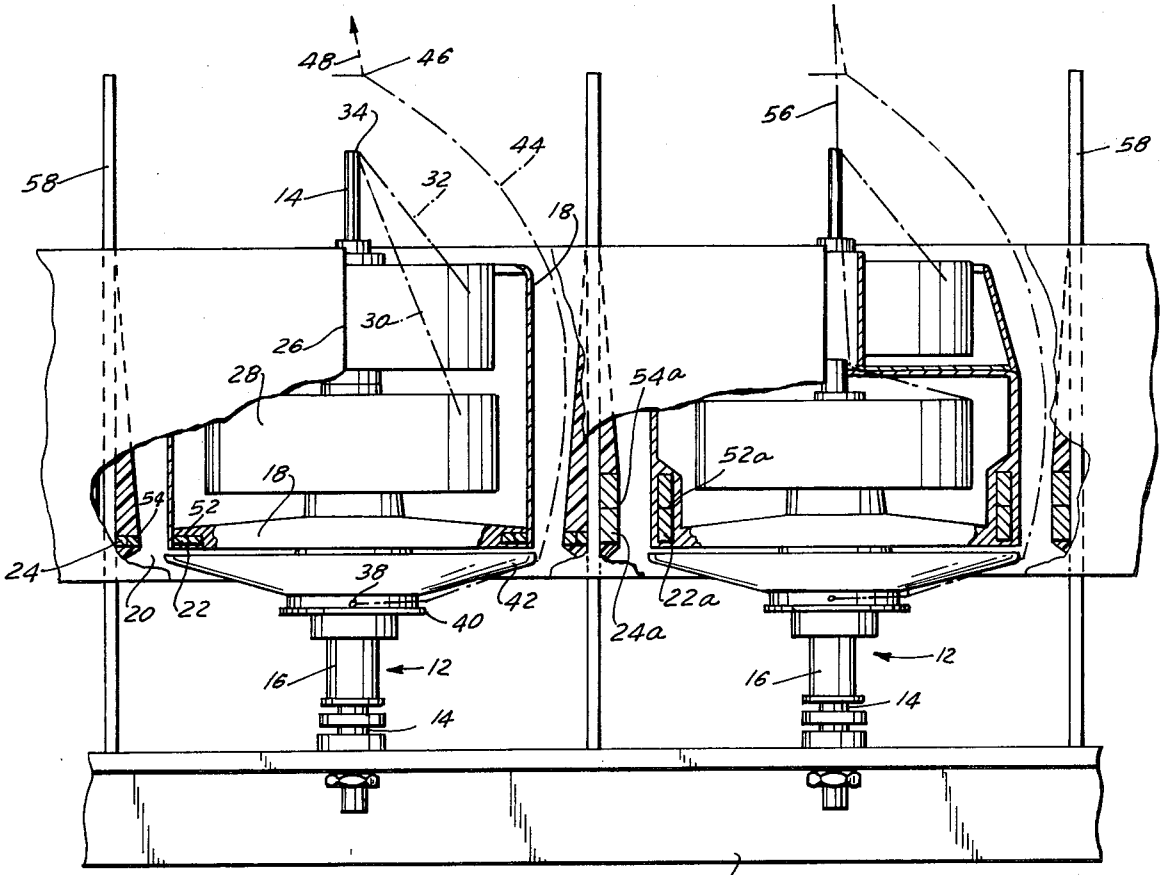
FIG. 1 is a front view partly broken away of a twisting apparatus.

As shown in FIG. 1 a spindle support 10 carries a plurality of twisters 12 each having a spindle shaft 14 formed with a whorl 16 adapted to be driven by a flat belt for rotation of the respective arrangement at high speed about a respective upright axis 56. A pair of yarn packages 26 and 28 are supported on a holder 18 rotatably carried on shaft 14. A permanent-magnet arrangement 20 comprising magnets 22 and 24 inhibits rotation of the holder 18 relative to the support 10.

In the left-hand twister 12 of FIG. 1 the magnets 22 and 24 are polarized about vertical axes 52 and 54, respectively, parallel to the axis 56. In the right-hand twister 12 magnets **22*a* and 24*a* are employed which are polarized about respective axes 52*a* and 54*a* which extend radially of the axis 56. It is noted that in FIG. 1 the magnets 22, 22*a*, 24, and 24*a* are shown offset 45°** from their actual positions in the arrangement.

Yarns 30 and 32 are pulled from the packages 28 and 26 respectively and passed first upwardly to the upper end 34 of the inlet tube arrangement. The yarns 30 and 32 pass the lower part of the twister 12 through a radial hole 38 in a reservoir drum 40, then up over a flyer 42 to form a balloon 44 around the tubularly cylindrical holder 18. Thereafter the yarns pass out in the direction 48 through an axially centered eye 46. As is shown the twisters 12 are each contained within walls indicated generally at 58.

Figure 2:
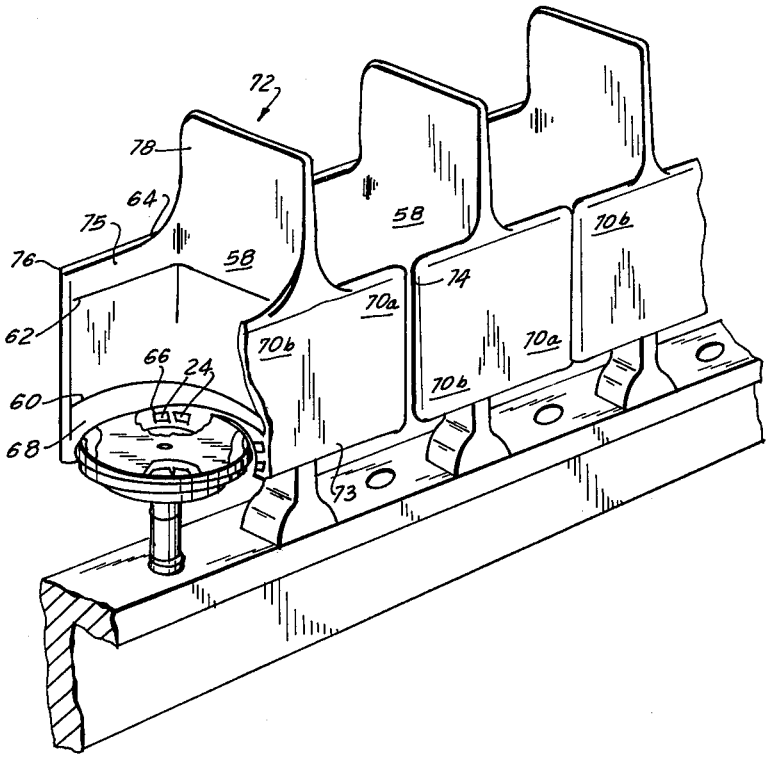
FIG. 2 is a perspective view partly broken away of the apparatus of FIG. 1.

FIG. 2 shows in more detail how the encapsulating walls 58 form adjacent their bases 68 a circle 60 and adjacent their upper edges 64 a square 62. The magnets 24 are visible on the inner faces 66 of these structures.

In addition as best shown in FIG. 2 the walls 58 are formed as two parts **70*a*, 70*b* defining a slot 74 for threading of the arrangement. Between them they define a common wall 72 which extends upwardly at 78 well above the holders. Furthermore the front wall 73 and back wall 75 are considerably lower so as to permit access to the arrangement. At their rear walls 75 the parts abut at a line 76**. These structures are made of light cast aluminum or of synthetic-resin material.

Figure 3:
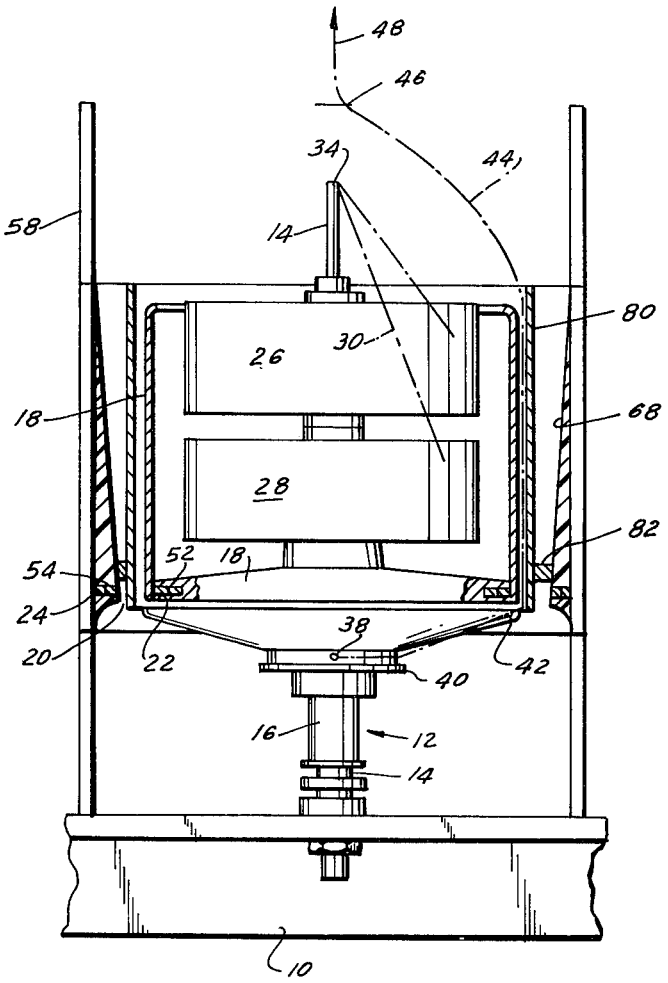
FIG. 3 is a vertical section through the twisting apparatus according to this invention.

As shown in FIG. 3 the device is set up so as to be able to receive a cylindrical sheet-aluminum sleeve 80 provided adjacent its lower edge with an elastomeric square-section ring 82. This ring 82 fits within the frustoconical surface 68 of the base part of the walls 58 so as accurately to center the sleeve 80 on the axis 56 of the arrangement. Thus it is possible to use this device without the sleeve 80 for relatively fine yarn, and with the sleeve 80 for relatively thick yarn so that would normally form a balloon 44 that would be so large that the yarn could be damaged by rubbing on the interior surface 68. This rubbing is particularly troublesome in an arrangement such as described here wherein the walls 58 define a square shaped at their upper portion so that a very large balloon would strike the flat walls at the corners and assuredly ruin the yarn.

In order to further prevent the element of breakage the interior of the sleeve 80 may be waxed either before use or continuously during use. Other lubricants may similarly be applied as well as size material or the like for the twisted filaments 30 and 32.

I claim:

1. In a twisting apparatus wherein a yarn package is supported on a rotatably supported holder in a laterally closed but upwardly open space defined between a plurality of upright walls defining at least adjacent their bases a circle, and wherein coacting magnets on said holder and at least one of said walls at the base thereof prevent rotation of said holder, the improvement comprising:

a balloon-limiting sleeve of generally cylindrical shape receivable between said holder and said walls, and an elastic ring on the exterior of said sleeve snugly engaging said walls for releasably securing said sleeve in said space on said walls for easy removal therefrom.

2. The improvement defined in claim 1 wherein said twisting apparatus further comprises a flyer under and rotatably supporting said holder and rotatable about an upright axis, said sleeve being centered on said axis when secured in said walls by said ring.

3. The improvement defined in claim 2 wherein said walls define at their tops a square centered on said axis and said circle defined by their bases is also centered on said axis.

4. The improvement defined in claim 1 wherein said sleeve is aluminum.

5. The improvement defined in claim 4, further comprising means for rotating said flyer at high speed about said axis.

6. The improvement defined in claim 5, further comprising means including a takeup eye above said package on said axis for pulling yarn up from between said sleeve and said holder.

7. In a twisting apparatus wherein a yarn package is supported on a rotatably supported holder in a laterally closed but upwardly open spaced defined between a plurality of upright walls defining at least adjacent their bases a circle, and wherein coacting magnets on said holder and at least one of said walls at the base thereof prevent rotation of said holder, the improvement comprising:

a balloon-limiting sleeve of generally cylindrical shape receivable between said holder and said walls, means for releasably securing said sleeve in said space on said walls for easy removal therefrom, and a flyer under and rotatably supporting said holder and rotatable about an upright axis, said sleeve being centered on said axis when secured on said walls, said walls defining at their tops a square centered on said axis and said circle defined by their bases is also centered on said axis, said means being a formation on said sleeve snugly engageable with said walls at the bases thereof, said formation engaging said walls generally at said magnets, said walls tapering at their bases and said formation being frustoconical and complementary to said walls at the bases thereof.

8. The improvement defined in claim 7 wherein said sleeve is provided with a circumferential ring of elastic material having said formation of frustoconical shape.

9. The improvement defined in claim 8 wherein said sleeve is of nonmagnetic material.

10. The improvement defined in claim 9, further comprising means or rotating said flyer at high speed about said axis.

11. The improvement defined in claim 10, further comprising means including a takeup eye above said package on said axis for pulling yarn up from between said sleeve and said holder.

* * * * *